United States Patent [19]

Jensen et al.

[11] Patent Number: 4,910,838

[45] Date of Patent: Mar. 27, 1990

[54] METHOD FOR PROVIDING A DESIRED SOUND FIELD AS WELL AS AN ULTRASONIC TRANSDUCER FOR CARRYING OUT THE METHOD

[75] Inventors: Morten B. Jensen, Virum; Bjarne Stage, Copenhagen; Gitte Z. Olsen, Frederiksberg, all of Denmark

[73] Assignee: Aktieselskabet Bruel & Kjaer, Naerum, Denmark

[21] Appl. No.: 292,219

[22] Filed: Dec. 29, 1988

Related U.S. Application Data

[63] Continuation of Ser. No. 46,890, May 5, 1987, now abandoned.

[30] Foreign Application Priority Data

May 7, 1986 [DK] Denmark ..... 2125/86

[51] Int. Cl.[4] ..... H04R 17/00

[52] U.S. Cl. ..... 29/25.35; 29/594; 310/312

[58] Field of Search ..... 29/25.35, 594; 310/363, 310/364, 365, 312

[56] References Cited

U.S. PATENT DOCUMENTS

| | | | |
|---|---|---|---|
| 2,956,184 | 10/1960 | Pollack | 310/358 |
| 4,452,084 | 6/1984 | Taenzer | 310/365 |
| 4,460,841 | 7/1984 | Smith et al. | 310/334 |
| 4,518,889 | 5/1985 | Thoen | 310/357 |
| 4,639,391 | 1/1987 | Kuo | 29/620 |

FOREIGN PATENT DOCUMENTS

| | | |
|---|---|---|
| 2257865 | 5/1974 | Fed. Rep. of Germany . |
| 2129253A | 5/1984 | United Kingdom . |

OTHER PUBLICATIONS

R. A. Burrier et al., Circularly Symmetric Gaussian Field Transducer with Equal Impedance and Equal Voltage Electrode Design, 1983, Ultrasonics Symposium, pp. 570–572.

G. H. Harrison et al., Ultrasonic Transducer Design for Uniform Insonation in Biomedical Ultrasound, 1985 Ultrasonics Symposium, pp. 630–633.

*Primary Examiner*—P. W. Echols

*Attorney, Agent, or Firm*—Scully, Scott, Murphy & Presser

[57] ABSTRACT

The present invention provides a substantially gauss-shaped sound field by means of an ultrasonic transducer, the potential on one side of the transducer being varied continuously by means of a thick-film electrode applied in a uniform or varying thickness. The thick-film can be a resistance paste or a conductive paste applicable in different thicknesses onto selected portions of the surface in question. The resistance paste can for instance be trimmed to different resistance values on selected portions of the surface. Such a technique makes it possible to alter the distribution of the potential so as to vary the distribution of the pressure in the sound field in such a manner that for instance a substantially gauss-shaped sound field is obtained.

9 Claims, 5 Drawing Sheets

Fabricating a polarized disc shaped piezoelectric body with electrodes on both sides for providing a predetermined sound field, preferably a substantially gauss-shaped sound field.

↓

Applying a layer, with one or several coatings, either even or in different thicknesses, of resistance material with at least one resistance paste on one side of said piezoelectric body. Polymer thick-film pastes can be applied as the resistance material, which are curable at a sufficiently low temperature such that the polarization of the transducer material of the piezoelectric body is maintained. Moreover, the resistance paste can be applied symmetrically about the center of the disc shaped piezoelectric body.

FIG.6

METHOD FOR PROVIDING A DESIRED SOUND FIELD AS WELL AS AN ULTRASONIC TRANSDUCER FOR CARRYING OUT THE METHOD

This is a continuation of copending application Ser. No. 07/046,890, filed on May 5, 1987, now abandoned.

FIELD OF THE INVENTION

The invention relates to a method for providing a substantially gauss-shaped sound field by means of an ultrasonic transducer.

BACKGROUND ART

It is known to divide one electrode into rings and to apply alternating voltages of varying amplitudes to the various rings. Such a procedure requires, however, particular control circuits.

SUMMARY OF THE INVENTION

The object of the invention is therefore to show how these control circuits can be avoided, and the method according to the invention is characterized in that the potential on one side of the transducer is continuously varied by means of a thick-film electrode applied in a uniform or varying thickness. The thick-film may be a resistance paste or a conductive paste applied in different thicknesses onto different portions of the surface in question. The resistance paste can for instance be trimmed to different resistance values on different portions of the surface. Such a technique allows an alteration of the distrbution of the potential so as to vary the distribution of the pressure in the sound field as desired. In this manner a substantially gauss-shaped sound field may be obtained.

A further advantage of such an apodizing technique is that it does not require space for additional components as may be required for control circuits, etc., and the transducer does not take up more space than a nonapodized transducer.

The invention concerns furthermore an ultrasonic transducer comprising a piezo-electric oscillating member optionally polarized in the thickness direction and provided with an electrically conductive surface layer. The ultrasonic transducer is characterised by the conductive surface layer being a paste applied in a uniform or a varying thickness, whereby a particularly simple construction for a transducer is obtained.

BRIEF DESCRIPTION OF DRAWING

The invention will be described below with reference to the accompanying drawings, in which FIG. 6 illustrates a block diagrram showing preferred steps of amethod for producing an ultrasonic transducer.

DESCRIPTION OF PREFERRED EMBODIMENTS

The varying surface speed across a piezo-electric transducer makes it possible to establish a distribution of the sound pressure providing a shaped sound beam adapted to a specific purpose. It is for instance desired to have a gauss-shaped distribution of the sound pressure provided by varying the potential continuously across the transducer. According to the invention the potential is varied continuously by employing a thick-film as one electrode. It is possible to apply such a thick-film onto both plane and curved surfaces of both rectangular and circular transducers. The thick-film may be of resistance paste or conductive past or different pastes on different portions of the surface. It can also be applied in different thicknesses and be trimmed to selected resistance values on selected portions of the surface.

The materials can be polarized both prior to and after the application and curing. Such a technique allows a desired distribution of the potential across the surface whereby the distribution of the pressure in the sound field can be varied as desired. The transducer material is for instance ceramic $BaTiO_3$, ceramic $PbZrO_3$, ZnO, CdS or PVDF.

Figure 1:
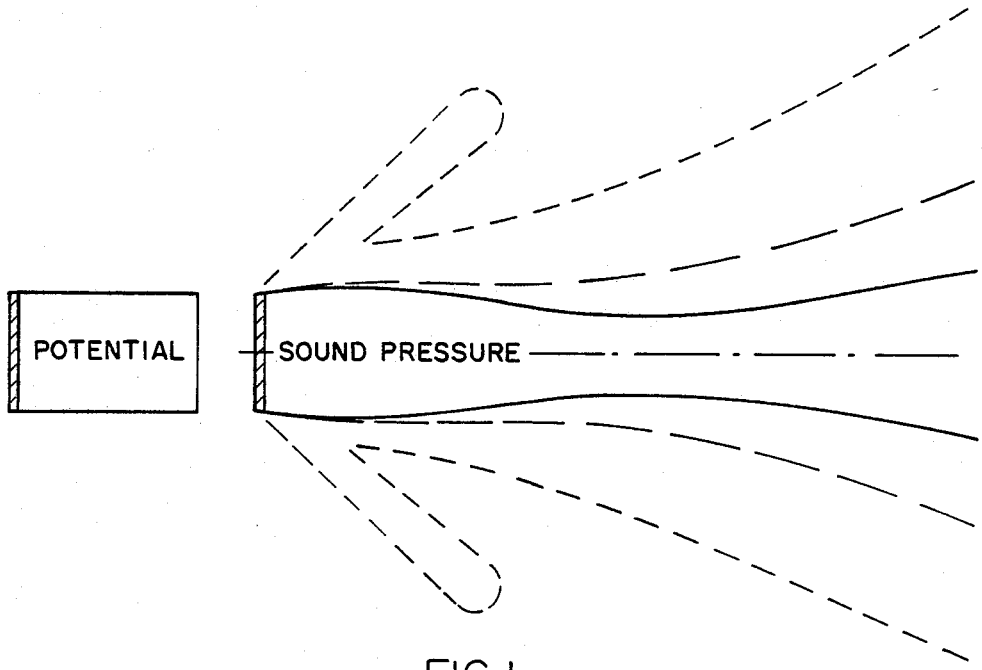
FIG. 1 (PRIOR ART)
FIG. 1 illustrates a nonapodized ultrasonic transducer generating a radiated sound field.
Figure 2:
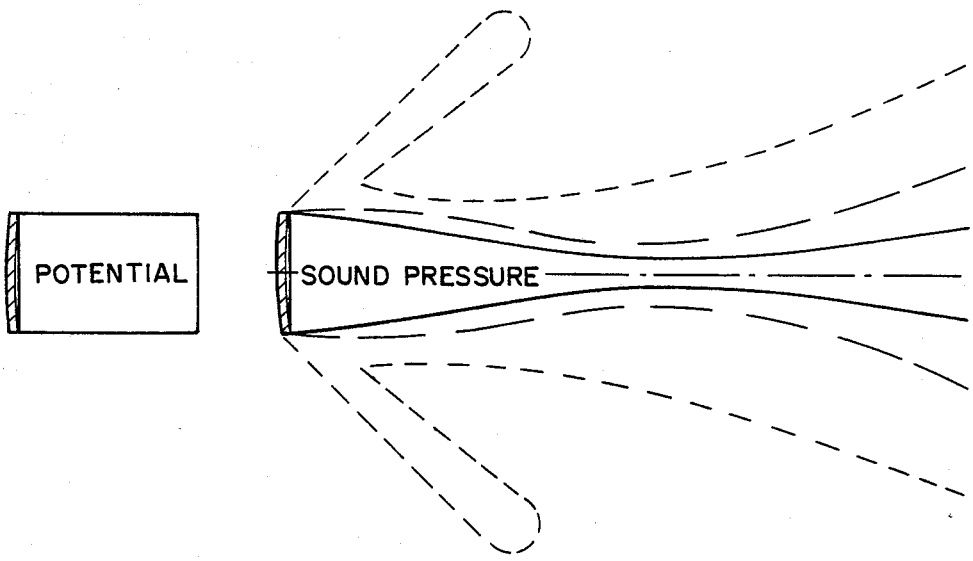
FIG. 2 (PRIOR ART)
FIG. 2 illustrates a nonapodized ultrasonic transducer comprising a curved surface.
Figure 3:
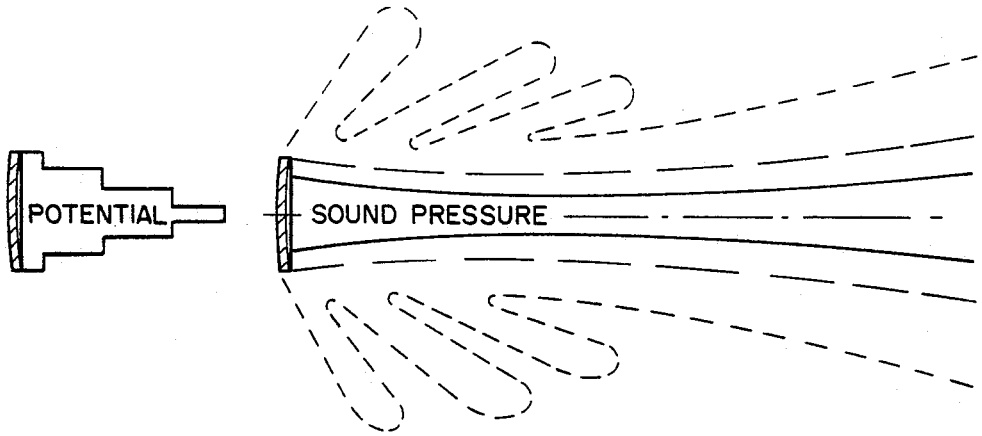
FIG. 3 (PRIOR ART)
FIG. 3 illustrates a traditionally apodized ultrasonic transducer generating side loops in the radiated sound field.
Figure 4:
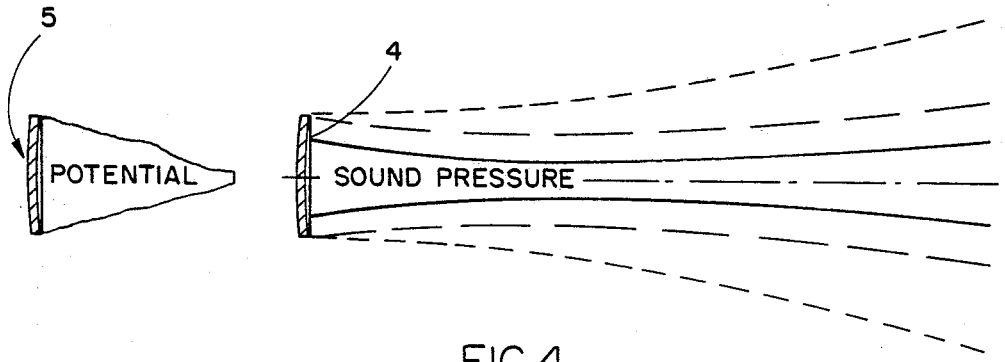
FIG. 4 illustrates a thick-film apodized ultrasonic transducer which does not generate side loops in the radiated sound field.

FIG. 4 illustrates an example of the surface potential as well as the distribution of the pressure in the sound field of an ultrasonic transducer according to the invention, i.e. the sound pressure compared to the pressure at the center line (isobars).

Figure 5:
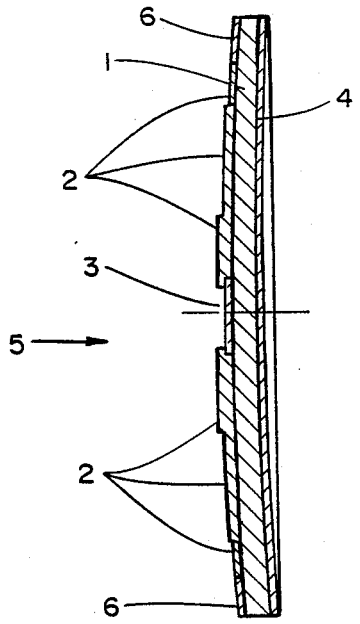
FIG. 5 illustrates on a larger scale a preferred embodiment or best mode of the ultrasonic transducer of FIG. 4.
Figure 7:
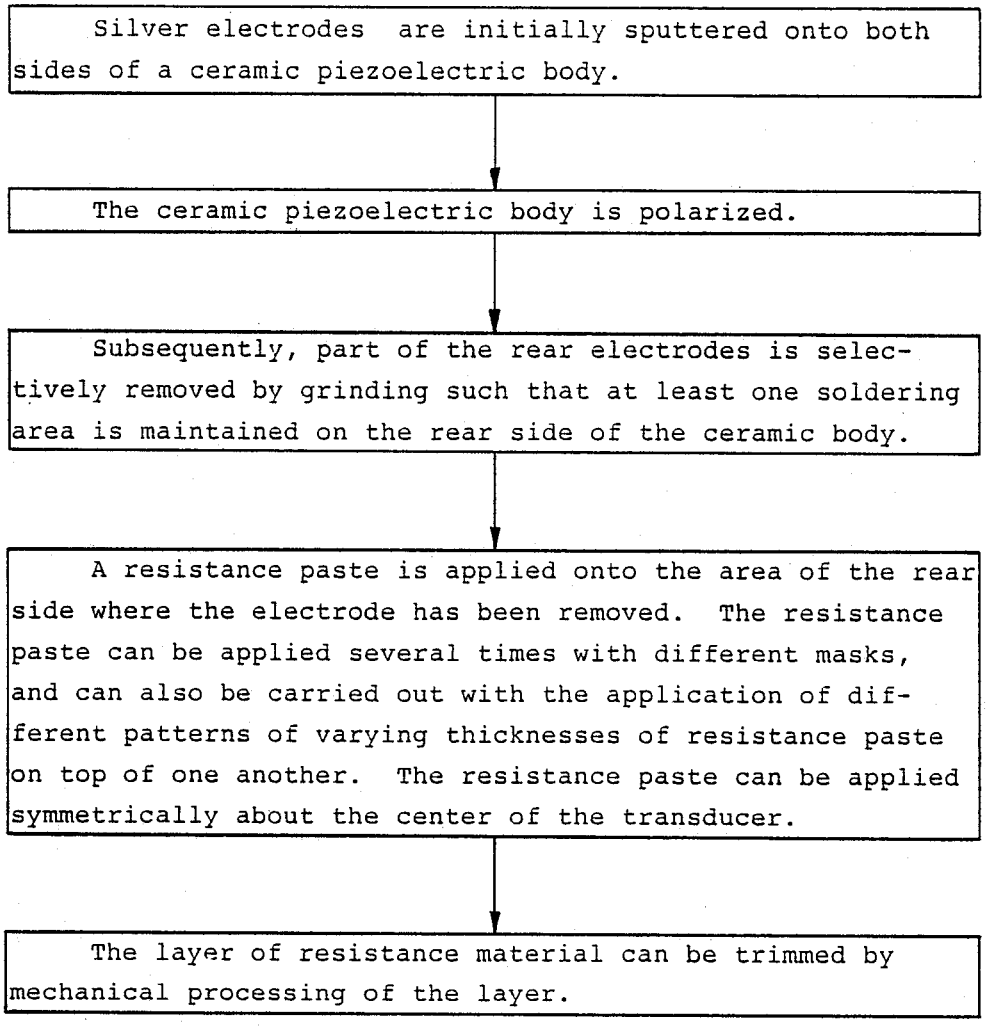
FIG. 7 illustrates a block diagram showing the steps of producing one particular preferred embodiment of an ultrasonic transducer.

FIG. 5 illustrates on a larger scale a preferred embodiment or best mode of the ultrasonic transducer of FIG. 4, whereby 1 is the piezo-electric member, 2 is th resistance paste, 3 is a conductive soldering area, and 4 is the second electrode on the front side of the transducer.

Polymer pastes, i.e. leader paste or resistance paste, are preferably used as such pastes can be cured at low temperatures, i.e. below the curie point of the piezo-electric crystal, and consequently applied onto a polarized ceramic without destroying the polarization during the curing procedure. Other types of paste to be cured at a temperature above the curie point of the piezo-electric crystal are, however, also possible. In the latter case the polarization must be carried out after the curing procedure.

APPLICATION

The substrate can either be a ceramic with electrodes sputtered or smeared thereon or a ceramic without electric According to a specific embodiment silver electrodes are sputtered onto both sides of the ceramic which is subsequently polarized. Then part of the rear electrode on the rear side 5 is removed by grinding, with a soldering area 3 being maintained in the middle of the rear electrode of the ceramic as well as an annular soldering area 6 forming the outermost annular portion of the rear electrode of the ceramic. The soldering areas can be distributed as desired in accordance with varying voltage pulses to be applied thereto. In this manner the shape of the radiation can be varied. A thick-film can also be applied to form voltage-dividing circuits with an insulating layer which is applied to the electrode. According to the specific embodiment, the resistance paste 2 is applied in the area of the ceramic where the electrode has been removed, as three annular rings of three different thicknesses as illustrated in FIG. 5; Plane ceramics involve serigraphy and convex/concave ceramics involve tampon pressing. In connection with ceramics to be used as single transducers or in transducer units for mechanical scanners, the paste is applied symmetrically about the center of the transducer, and in connection with transducer units for arrays, the paste is applied symmetrically about the center line of the array.

Single transducers and transducer units for mechanical scanners are typically circular, whereas transducer units for arrays are rectangular. The application can, however, be carried out on transducers of all geometries.

Upon the application the paste is dried as indicated by the manufacturer—in the specific embodiment at 110° C. for 5 minutes. After drying, the ceramic is cured as indicated by directions from the the manufacturer.

TRIMMING

The resistance through the paste can be varied in order to obtain the desired distribution of the potential across the ceramic. The latter is carried out either during the application where the application can be repeated several times with various masks followed by application of various patterns of varying thicknesses as rings, as shown at 2 in FIG. 5, or stripes on top of one another, or it can be carried out by a mechanical processing of the layers, i.e. patching, grinding, milling etc, to achieve the desired patterns. It is also possible to achieve a continuous distribution of the potential as the layer need not be interrupted at all.

The soldering areas can be distributed as desired on the rear electrode of the ceramic as the application of varying voltage pulses at varying distances from the center the rear electrode of the ceramic as the application of varying voltage pulses at varying distances from the center of the ceramic makes it possible to obtain the desired distribution of the potential. The voltage-dividing circuits can be provided by means of thick-films applied on the insulating layer. Referring to FIG. 4, the surface potential illustrated on the left side thereof illustrates a high potential applied to the center of a transducer pursuant to the present invention and a lower potential applied to the outer annular portion thereof, with the potential varying across the radius of the transducer as illustrated on the left side of FIG. 4 to produce the distribution of pressure in the sound field (without side lobes) illustrated on the right side of FIG. 4. When a high potental is applied to the central soldering electrode area 3 and a lower potential is applied to the outer annular soldering electrode area 6, then the annular rings 2 of different thickness resistance paste function as voltage-dividing circuits to produce the distribution of electrical potential illustrated on the left side of FIG. 4.

The ultrasonic transducer is preferably operated at a frequency of 2–20 MHz by input voltage pulses of up to about 200 V.

In this manner the present invention provides an ultrasonic transducer not taking up more space than a nonapodized transducer and not generating the undesired sideloops.

An ultrasonic transducer with a thick-film apodizing layer can for instance be used for medical diagnostics, medical therapy, non-destructive examination, measurements of the layer thickness, submarine measurements etc., wherein a narrow band width is required in view of the required picture resolution in as large a part of the picture field as possible.

We claim:

1. A method for producing an ultrasonic transducer comprising:
   a. fabricating a polarized disc shaped piezoelectric body with electrodes on both front and rear sides thereof for providing a predetermined sound field, preferably a substantially gauss-shaped sound field;
   b. applying at least two different thicknesses of resistance material on one side of said piezoelectric body.

2. A method for producing an ultrasonic transducer as claimed in claim 1, wherein the resistance material comprises resistance paste.

3. A method for producing an ultrasonic transducer as claimed in claim 2, wherein the resistance paste is applied in annular rings of different thicknesses positioned symmetrically about the center of the disc shaped piezoelectric body.

4. A method for producing an ultrasonic transducer as claimed in claim 2, wherein the different thicknesses of resistance paste are applied by applying several coatings of resistance paste on the one side of the piezoelectric body.

5. A method for producing an ultrasonic transducer as in claim 2, wherein polymer thick-film pastes are applied as the resistance paste which are curable at a sufficiently low temperature that the polarization of the transducer material of the piezoelectric body is maintained.

6. A method for producing an ultrasonic transducer as in claim 2, wherein silver electrodes are initially sputtered onto both front and rear sides of said piezoelectric body which is a ceramic piezoelectric body, the ceramic piezoelectric body is polarized, and subsequently part of the electrode on said rear side is selectively removed by grinding such that at least one soldering area is maintained on the rear side of the ceramic body, whereafter a resistance paste is applied in different thicknesses onto the area of the rear side where the electrode has been removed.

7. A method for producing an ultrasonic transducer as in claim 6, wherein the application of resistance paste is carried out several times with different masks, and is also carried out with the application of different patterns of varying thicknesses of resistance paste on top of one another.

8. A method for producing an ultrasonic transducer as in claim 6, wherein a layer of resistance material is trimmed by mechanical processing of the layer.

9. A method for producing an ultrasonic transducer as claimed in claim 8, wherein the resistance paste is applied symmetrically in annular rings about the center of the transducer.

* * * * *